United States Patent [19]

Sumner

[11] 4,416,493

[45] Nov. 22, 1983

[54] WALL MOUNTED DISPLAY CASE FOR STUFFED ANIMALS

[76] Inventor: Gary D. Sumner, 6804 Bix Ave., Citrus Heights, Calif. 95610

[21] Appl. No.: 257,701

[22] Filed: Apr. 27, 1981

[51] Int. Cl.[3] ..... A01K 1/00

[52] U.S. Cl. ..... 312/245; 312/204; 312/111; D6/5; D21/129; 119/17

[58] Field of Search ..... 312/245, 204, 111; D6/5, 2, 1; D21/59, 121, 129; 119/17, 19

[56] References Cited

U.S. PATENT DOCUMENTS

| | | | |
|---|---|---|---|
| D. 91,950 | 4/1934 | Liska | D6/2 |
| D. 149,940 | 6/1948 | Greenbaum | D6/5 |
| D. 163,149 | 5/1951 | Strand | D6/5 |
| D. 172,876 | 8/1954 | Goldman et al. | D6/5 |
| D. 174,121 | 3/1955 | Goldman et al. | D6/5 |
| D. 236,523 | 8/1975 | Reiling | D21/129 |
| 989,029 | 4/1911 | Newcomb | 119/17 |
| 1,990,191 | 2/1935 | Leindorf | 119/17 |
| 3,955,863 | 5/1976 | Yellin | 312/111 |
| 4,160,570 | 7/1979 | Bridges | 312/245 |
| 4,165,852 | 8/1979 | Chervenak | 312/245 |

*Primary Examiner*—Victor N. Sakran
*Attorney, Agent, or Firm*—Mark C. Jacobs

[57] ABSTRACT

A wall mounted three-dimentional display case adapted to be mounted flush to a vertical wall, the display case simulating a wheeled vehicle, such as a circus wagon, having an animal cage thereon, and being adapted to contain therein and on top thereof a plurality of stuffed, flexible or non-flexible, animals, the heads and limbs of the animals being adapted to extend out of the bars of the cage to simulate animals caged in the wagon thereby presenting an overall pleasing effect.

8 Claims, 6 Drawing Figures

WALL MOUNTED DISPLAY CASE FOR STUFFED ANIMALS

BACKGROUND OF THE INVENTION

1. Field of the Invention

The invention relates to display cases; and, more particularly, to a three-dimentional wall mounted display case for retaining therein and displaying a plurality of stuffed animals or the like.

2. Description of the Prior Art

It is well known that young children like to receive and collect stuffed animals and the like. These animals come in various colors, sizes and shapes and simulate animals such as hippos, bears, dogs, cats, etc.

It is no secret that these animals take up quite a bit of space and can get easily damaged and dirty. Many parents merely throw the animals in a toy box or the like. Again, they can get easily broken in stacking them in this manner. Further, such animals are usually quite colorful and may be very expensive It is therefore desirable to display such animals in a pleasing manner. However, the usual child's bedroom does not have sufficient shelf space to display all of the animals a child may accumulate.

There is thus a need for displaying a collection of stuffed animals or the like in a manner taking up little space but providing a pleasing array of such animals. Such a display should blend in with the decor of the room and be relatively inexpensive and easy to assemble.

SUMMARY OF THE INVENTION

It is an object of this invention to provide a display case for holding stuffed animals or the like.

It is a further object of this invention to provide a three-dimensional wall-mounted display case that simulates a wheeled circus wagon having a cage thereon with the animals adapted to be "caged" therein.

It is still another object of this invention to carry out the foregoing object in a manner in which portions of the animals may extend out of the bars of the cage giving a natural effect to the cage.

It is still another object of this invention to carry out the foregoing objects in a simple and inexpensive manner.

These and other objects are preferably accomplished by providing a wall mounted three-dimensional display case adapted to be mounted flush to a vertical wall. The display case simulates a wheeled vehicle, e.g. circus wagon, having an animal cage thereon, and is adapted to contain therein and on top thereof, a plurality of stuffed, flexible or non-flexible, animals, the heads and limbs of the animals being adapted to extend out of the bars of the cage to simulate animals caged in the wagon thereby presenting an overall pleasing effect.

DESCRIPTION OF THE PREFERRED EMBODIMENT

Figure 1:
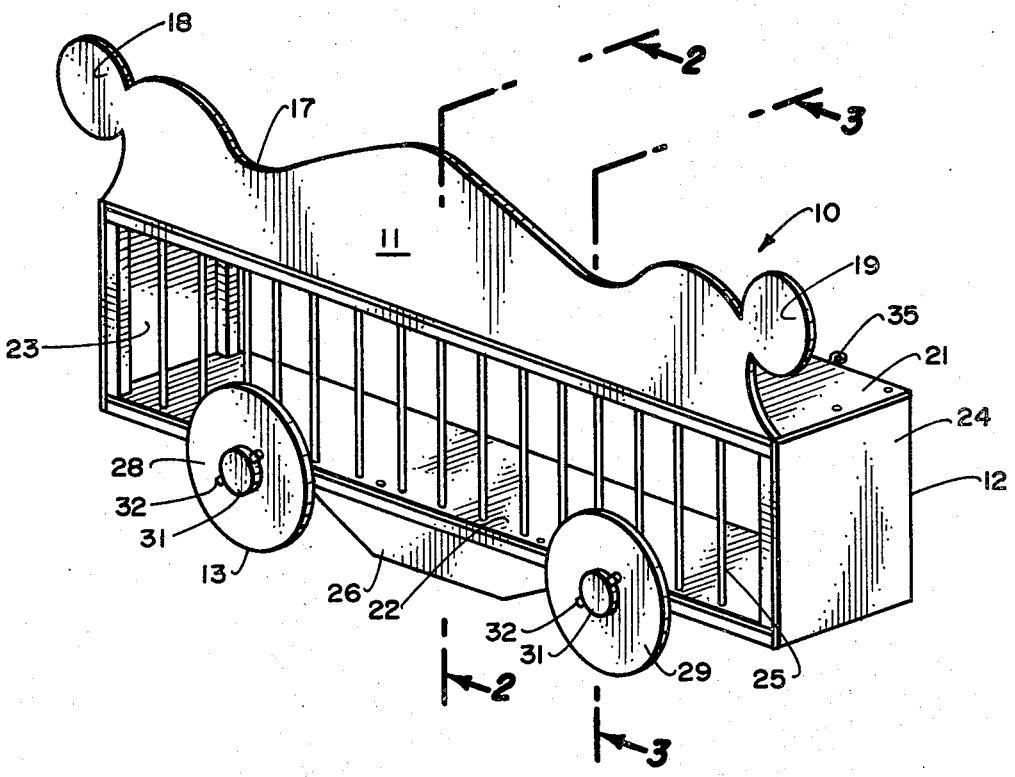
FIG. 1 is a front perspective view of a display case in accordance with the invention.
Figure 6:
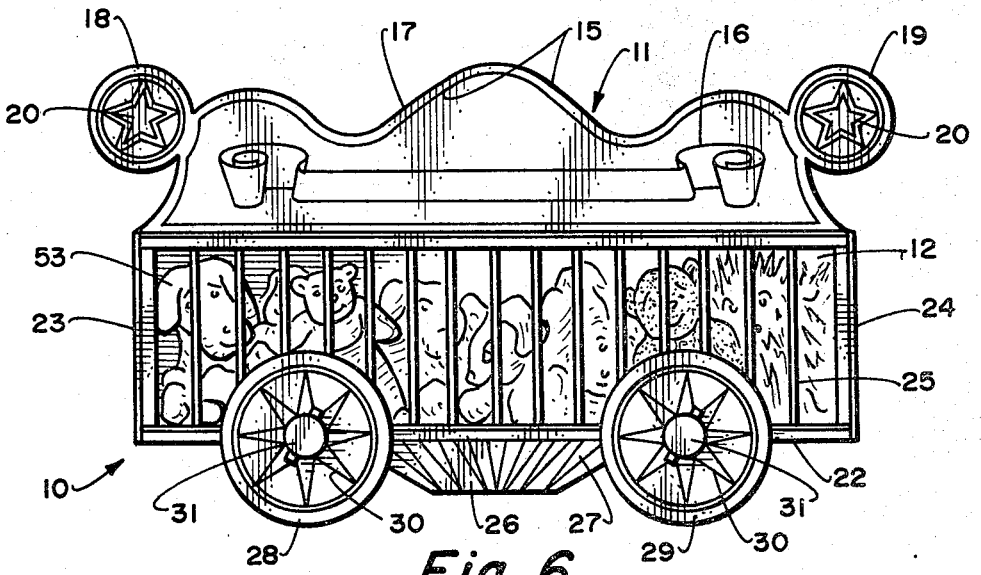
FIG. 6 is front vertical view of the assembled display case of FIGS. 1 through 5 showing a plurality of stuffed animals caged therein.
Figure 2:
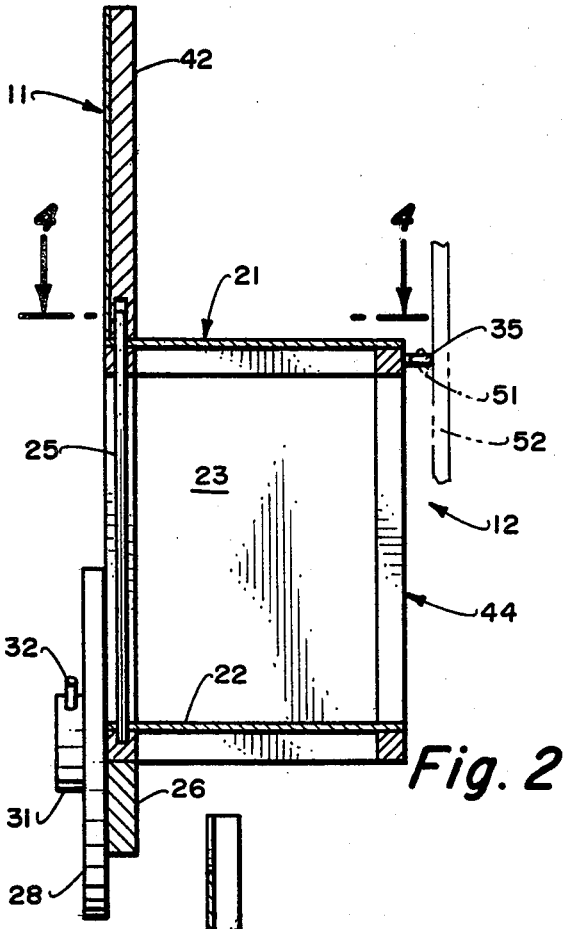
FIG. 2 is a view taken along lines 2—2 of FIG. 1.
Figure 3:
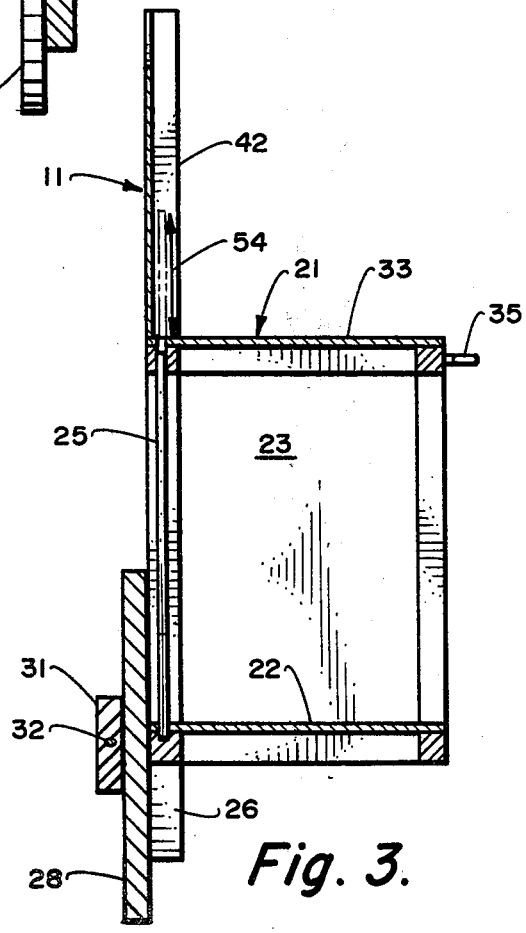
FIG. 3 is a view taken along lines 3—3 of FIG. 4.
Figure 4:
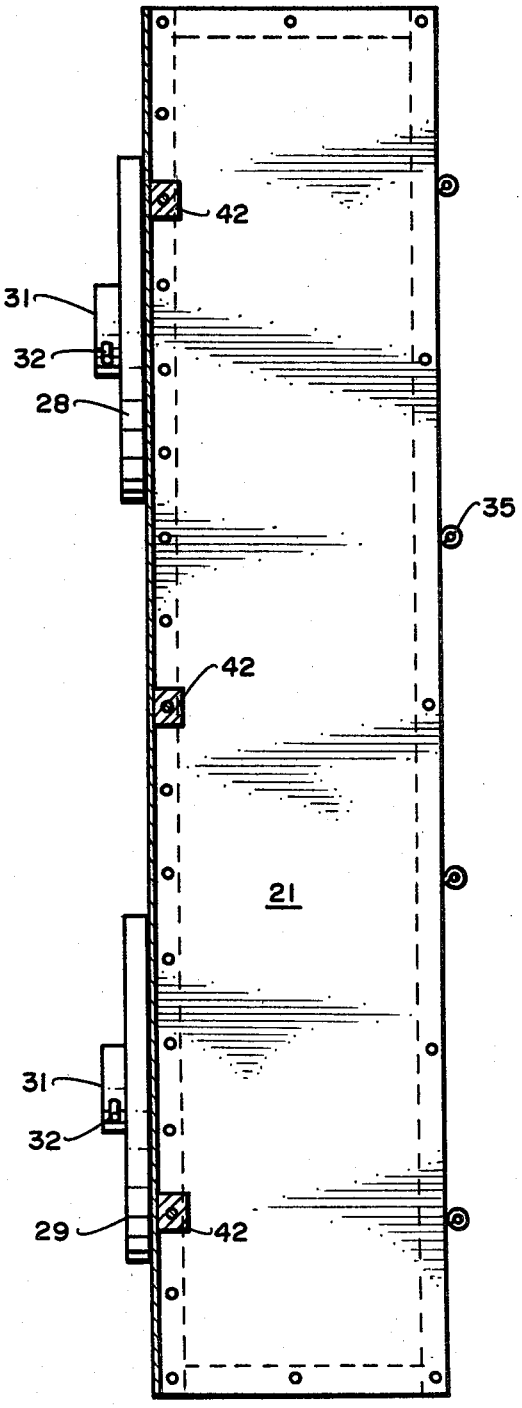
FIG. 4 is a view taken along lines 4—4 of FIG. 2.

Referring now to FIG. 1 of the invention, a three-dimensional display case 10 in accordance with the invention is shown in assembled condition. Case 10 includes a planar top section 11, a middle cage section 12 and a wheeled bottom section 13. As shown in FIG. 2, top section 11 may be uniform in thickness and covered by a decal or the like which may be preprinted with colorful indicia 15 (see FIG. 6) simulating the upper surface of a circus wagon. Of course, section 11 may be painted to simulate a circus wagon or the like. As can be seen in FIGS. 1 and 6, top section 11 is cut to simulate a fluted or undulating surface 17 with round circles 18, 19 at each end with stars 20 or other indicia giving a colorful effect. The indicia 16 extending along the upper section 11 (FIG. 6) may simulate a banner have written indicia thereon, such as CIRCUS WAGON; STUFFED CITY EXPRESS; CIRCUS TRAIN EXPRESS; etc., adding to the overall effect.

Middle section 12 simulates a cage having a top wall 21, a bottom wall 22, and end walls 23 and 24. As will be discussed, cage section 12 is open at the rear and closed off at the front by a plurality of spaced vertical elongated members 25 simulating bars of a cage.

As shown in FIGS. 1,2,3,5 and 6, a trapezoidal-shaped plate 26 is provided on the underside of bottom wall 22 adjacent the said front thereof to simulate the undercarriage of a circus train or the like. Again, plate 26 may be painted or decorated on the outer front surface thereof to simulate a circus wagon appearance. The wheels 28, 29 may also be painted or provided with preprinted decals or the like to simulate wheels, such as indicia 30 (FIG. 6). Each wheel 28, 29 may also include a central hub 31 having a dowel pin 32 extending therethrough. These pins 32 may be a unitary pin actually extending through the hub 31 or ends of such pins giving the illusion of such. Wheels 28,29 may be fixed in position or mounted for actual rotation as will be discussed.

As will be discussed, bars 25 are removable to provide access to the interior of caged section 12 to remove or add animals.

Figure 5:
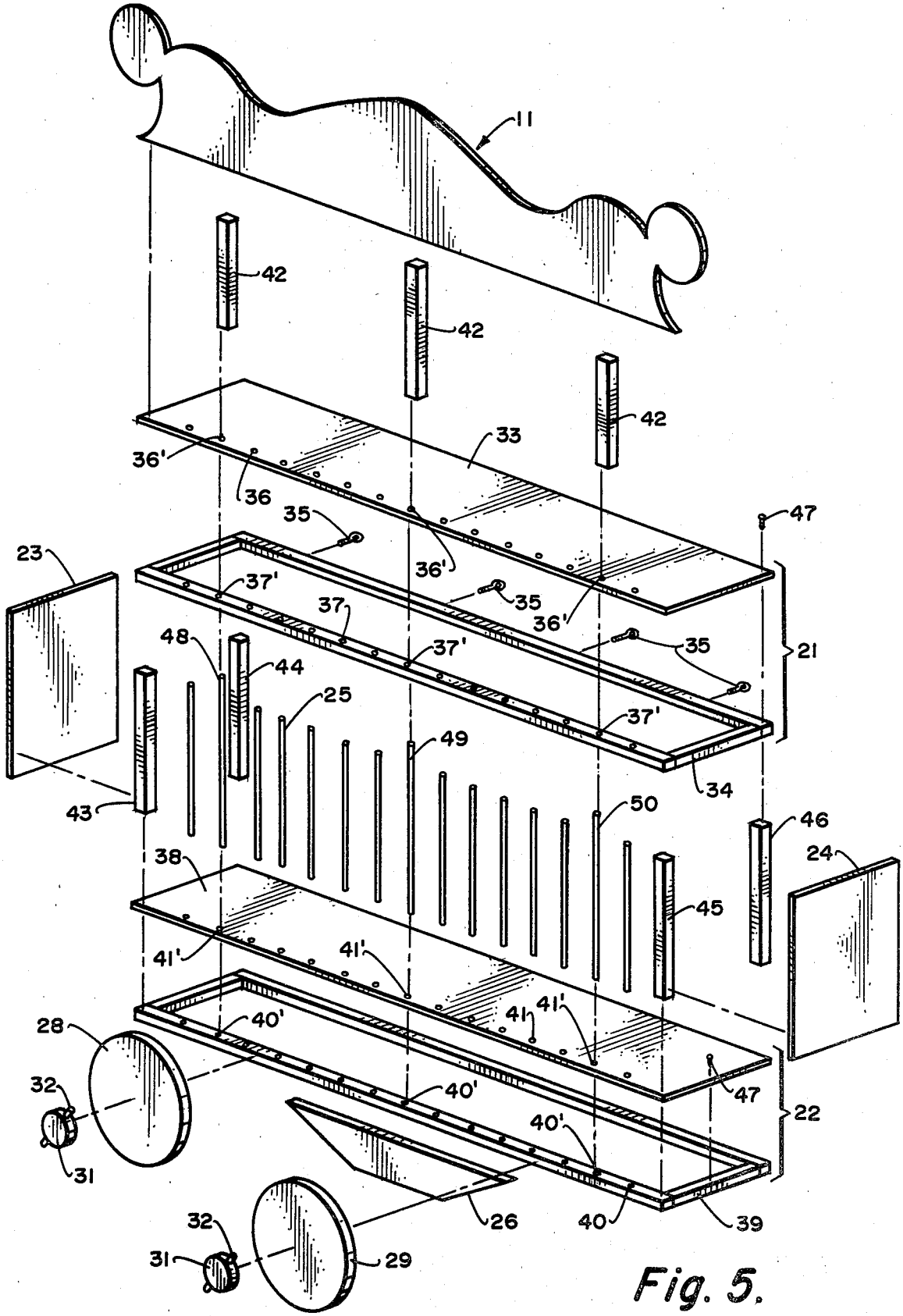
FIG. 5 is an exploded view of the case of FIGS. 1 through 4 prior to assembly.

As shown in FIG. 5, top wall 21 is formed of a flat planar rectangular section 33 and a mating rectangular frame section 34, a plurality, such as four, spaced eyelets 35 extend into the rear of frame section 34 for providing hooked members so that case 10 may be hung on suitable spaced wall mounted hooks, (such as hook 51 extending from wall portion 52 shown in phantom in FIG. 2). A plurality of spaced aligned holes 36, 37 are provided along the front of sections 33, 34, respectively, for receiving therein the bars 25. Holes 36, 37 extend all the way through their respective sections.

Bottom section 22 is also formed of rectangular sections 38, 39 similar in all respects to their respective sections 33, 34 except that holes 40 do not go all the way through section 39 (although holes 41 in section 38 do).

A plurality of spaced vertical support braces 42, such as three, are provided adjacent top section 11 (see also FIG. 1 through 4) and similar braces 43 through 46 are provided at each corner of section 12.

The assembly of the exploded view of FIG. 5 will now be described. Section 38 is secured to section 39 as by glueing, or nails, or screws 47 or the like. Holes 40 and 41 are in alignment. Section 33 is secured to section 34 in like manner. End panels 23, 24 are secured or screwed to bottom assembly 22 and each elongated dowel 48 through 50, which are longer than the remaining dowels forming bars 25, is inserted into its respective hole, such as aligned holes 41', 40'. Assembled top section 21 is then inserted by means of dowels 48 through 50 extending all the way through aligned holes 37', 36' in sections 33 and 34. Section 21 is then aligned for fit and screwed or otherwise secured to end panels 23, 24. Corner bracing members 43 through 46 are also secured in position and the remaining dowels 25 are inserted from the top (i.e., down through aligned holes 36, 37) into the aligned holes 41, 40 in bottom section 22.

The lower panel section 26 is then secured to the bottom of section 22, as by gluing, and wheels 28, 29 are also secured thereto. Dowels 32 are inserted into apertures in hubs 31 and secured to their respective wheels 28, 29. Top section 11 is then secured to the top upper front surface of section 21 with bracings 42 secured to both section 11 and the upper surface of section 21. The various decorative printing or indicia may be added (unless the various sections are prepainted or otherwise provided with indicia).

The final assembled display case 10 is shown in FIGS. 1 and 6. The smaller dowels forming bars 25 sit flush with the top panel 21. Wheels 28, 29 are fixed in position but can easily be made to rotate on bottom section 22 by suitable axles mounted thereon as is well known in the art. Sections 33, 34, 38, and 39 are formed as such primarily for rigidity and a single section may be provided, if desired, depending on the materials selected. Although wheels 28, 29 are shown as solid, they may have radial cut-out sections for added effect. By gripping bars 25, they can be lifted up and out as indicated by arrow 54 in FIG. 3, so access is provided to the interior of cage section 12. It will not usually be necessary to remove more than two or three. They are replaced in like manner.

As shown in FIG. 6, the animals 53 are disposed inside of cage section 12 and may have their limbs, heads, or other body portions extending between the bars 25 to add to the caged effect. Animals may also be placed on top of section 21 (FIG. 1) with body portions draping over panel sections 11 providing additional display. This is particularly suitable for larger stuffed animal that cannot fit inside of cage section 12.

Any suitable dimensions may be used. For example, the case 10 may be about 54" in overall length and the various sections of suitable dimensions. Any suitable materials may be used, such as various woods, masonite, metals, plastics, etc. Although screws and gluing have been discussed, brads, nails, or other securing means, such as magnets, may be used.

It can be seen that there is disclosed a three-dimensional display case which is wall mounted and stuffed animals may be displayed in an aesthetically pleasing manner simulating an animal's natural environment. Any suitable materials and method of assembly may be used and the indicia may be varied, as desired.

It is also to be understood that a variant means of assembly, also within the scope of the invention would provide aperture 36 in planar section 33 only for the elongated dowels 48-50. Thus bars 25 would extend upwardly through apertures 37 and only about the lower surface of planar section 33.

Since certain changes can be made in the above apparatus without departing from the scope of the invention, it is intended that all matter contained in the above description shall be interpreted as illustrative and not in a limiting sense.

I claim:

1. A wall mountable, three dimensional display case for displaying a plurality of stuffed animals or the like in an environment aesthetically pleasing to the eye comprising:

an elongated top planar section spaced from and secured to an elongated bottom planar section by side panels afixed to both of same, said sections and panels forming a box open along the front thereof and the rear thereof, a plurality of spaced elongated vertical members removably secured along the open front of said box simulating the spaced bars of a cage, wherein said members are dowels inserted into aligned holes in the top and bottom planar sections, the holes in the top planar section extending all the way through said top planar section, the holes in the bottom planar section extending only part way therethrough whereby dowels can be removed upwardly from said top and bottom planar sections, a pair of spaced circular planar sections mounted along the front lower portion of said box simulating wheels, and a vertical planar section mounted along the length of said top planar section, normal thereto, whereby after wall mounting, removal of selected ones of said dowels permits access to the interior of said box whereby stuffed animals may be inserted therein with subsequent replacement of said selected ones of said dowels thereby simulating the caging of animals inside of said cage.

2. In the case of claim 1 wherein the vertical planar section is fluted along its upper edge with circular members formed at each end thereof.

3. In the case of claim 1 including indicia on said sections and said wheels simulating indicia associated with a circus wagon or the like.

4. In the case of claim 1 including the bottom vertical planar section mounted along the front lower portion of said box between said circular planar sections simulating the undercarriage of a wheeled vehicle.

5. In the case of claim 1 including hook means along the upper rearsurface of said box adapted to mate with wall mounted hooks for hanging said case on a wall.

6. In the case of claim 1 including a hub having a cross-pin mounted at substantially the center of each circular planar section to simulate the central hub of a wheel.

7. In the case of claim 1 wherein certain ones of said dowels are longer than others and extending above the upper surface of said top planar section, said others being substantially flush with the upper surface of said top planar section.

8. In the case of claim 1 wherein each of said top and bottom planar sections is comprised of an open rectangular frame section and a flat planar rectangular section secured to each other.

* * * * *